United States Patent [19]

Elliott-Moore

[11] Patent Number: 4,552,488

[45] Date of Patent: Nov. 12, 1985

[54] MINE ROOF SUPPORT SYSTEM

[75] Inventor: Peter Elliott-Moore, Harvington, Nr. Evesham, England

[73] Assignee: Dowty Mining Equipment Limited, England

[21] Appl. No.: 457,424

[22] Filed: Jan. 12, 1983

[30] Foreign Application Priority Data

Feb. 3, 1982 [GB] United Kingdom ..... 8203047

[51] Int. Cl.[4] ..... E21D 15/44; E21D 23/26

[52] U.S. Cl. ..... 405/299; 137/529; 405/302

[58] Field of Search ..... 405/291, 302, 299; 137/529; 91/170 MP

[56] References Cited

U.S. PATENT DOCUMENTS

| | | | |
|---|---|---|---|
| 4,189,095 | 2/1980 | Monigold et al. | 137/529 X |
| 4,191,498 | 3/1980 | Weirich et al. | 405/302 |
| 4,247,226 | 1/1981 | Weirich et al. | 405/302 |
| 4,279,271 | 7/1981 | Neff | 137/529 X |
| 4,418,715 | 12/1983 | Balazs | 137/529 X |

*Primary Examiner*—David H. Corbin

*Attorney, Agent, or Firm*—Hayes, Davis & Soloway

[57] ABSTRACT

A mine roof support system including a relief valve communicable with the props of each roof support through respective control valve means, and a main return pipe for receiving liquid discharged, by way of the relief valve, from the props when liquid at high pressure is no longer supplied thereto and the roof support is being advanced. A movable element of the relief valve comprises at least two relatively-movable and connected parts and is so co-operable with its seating as to ensure that when the support is so advancing a substantially constant predetermined back-pressure is maintained in the props sufficient to maintain the support in contact with the mine roof. If the pressure in the main return pipe exceeds the pressure then subsisting in the control valve means, one of the parts of said element is caused automatically to close onto the seating.

5 Claims, 2 Drawing Figures

MINE ROOF SUPPORT SYSTEM

This invention relates to a mine roof support system in which a number of hydraulically-operated mine roof supports extend in a row, side-by-side, along a mineral face in a mine. As mineral is removed by cutting equipment from the face the supports are released from engagement with the roof of the mine, advanced to a position closer to the newly-cut face, and then re-set against the roof in that position.

As a roof support advances from its one position to its other position it is advantageous if, instead of being completely out of contact with the roof, it maintains contact with the roof and may provide some, if only a small, roof supporting function if that is desired.

In one known mine roof support system contact of an advancing roof support with the roof is effected by the use of a small-bore pipe carrying liquid at a low pressure, which liquid is supplied to the props of the roof support as it advances. However if, within the distance through which a roof support advances, the roof converges towards the floor or there is a step in the floor caused by the operation of cutting the mineral face, the height of the support will need to be reduced in order for the support to continue its advance in contact with the roof. Because the said pipe is of small bore, it may not be able to accommodate the liquid which must then be discharged from the props in order for them to shorten in length as rapidly as is necessary. In consequence a back-pressure will be set up in the pipe which will tend to at least hinder the shortening of the props and thus interfere with the advance of the support.

In another known mine roof support system the low pressure small-bore pipe is omitted and a conventional relief valve is provided between a pipe through which liquid discharges from the props and a main return line. To enable the props to shorten in length for advancing of the roof support, this relief valve opens so that liquid discharging from the props freely passes into the main return line. However this system suffers from the disadvantage that if due to return flow from other services using the same main return line, or due to the discharging flow under extreme conditions from the props themselves, undesirably high pressure is developed in the main return line, the effective pressure developed in the props during advance of the roof support is at least equal to the sum of the pressure setting of the relief valve plus whatever pressure is at the time existing in the main return line. As a result undesirable loading of the props in the extending direction takes place causing resistance to support advance and possible floor penetration.

The object of this invention is to provide an improved roof support system.

In accordance with the present invention, a mine roof support system includes hydraulically-operated mine roof supports, a main pipe for supplying liquid at high pressure and by way of respective control valve means to the prop or props of each of the roof supports for full roof support, a respective relief valve communicable with said prop or props through said control valve means, and a main return pipe for receiving liquid discharged, by way of said relief valve, from said prop or props when said high pressure is no longer supplied thereto and the respective said roof support is being advanced, the movable element of said relief valve comprising at least two relatively-movable and connected parts and being so co-operable with its seating as to ensure that when said support is so advancing a substantially constant predetermined back-pressure is maintained in said prop or props sufficient to maintain the support in contact with the mine roof, but if the pressure in said main return pipe exceeds the pressure then subsisting in said control valve means, one of said parts of said element is caused automatically to close onto said seating.

Advantages offered by the invention are mainly that upon said element so closing onto its seating, pressure liquid in said return pipe is prevented from being applied in said prop or props and thus undesirable loading of the prop or props in the extending direction, which would otherwise offer resistance to, or effect prevention of, support advance and possibly cause mine floor penetration, is avoided. Further, in the event that maintenance of said control valve means is required, said element, on so closing and preventing flow from the main return pipe into those means, permits this.

Preferably, said parts of said movable element of the relief valve are connected together with a predetermined amount of lost motion.

Also in accordance with the invention a relief valve, suitable for use in a mine roof support system, includes a valve seating and a movable element, co-operable with said seating, which comprises two parts one of which is connected to the other with a predetermined amount of lost motion, said movable element being so constructed and so co-operable with said seating as to provide a variable throttle effect thus to control the flow of liquid from the upstream side of the valve to the downstream side thereof whereby, provided the pressure on the downstream side of the valve does not exceed that on the upstream side, the said pressure on the upstream side is maintained at a substantially constant predetermined value irrespective of the pressure on the downstream side, but if said pressure on the downstream side of said valve exceeds said pressure on the upstream side, said one part of the movable element so moves with respect to the other part as automatically to close onto said seating to prevent flow of liquid from occurring from the downstream side of the valve to the upstream side thereof.

One way of carrying out the invention is described in detail below with reference to drawings which illustrate only one specific embodiment, in which.

Figure 1:
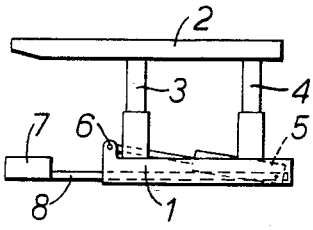
FIG. 1 is a diagrammatic side elevation of a mine roof support.

The mine roof support system includes a number of roof supports each of which, as shown in FIG. 1, comprises a floor beam 1, a roof beam 2, a pair of hydraulically-extendible props 3, 4 disposed between the floor beam and the roof beam, and an advancing jack 5 mounted in a gap in the floor beam and pivotally secured at 6 at the front end of the floor beam. The free end portion of the advancing jack 5 is connected to a conveyor 7 by a relay bar 8, whereby the jack 5 can advance the support when released from the roof and can advance the conveyor when the support is engaged with the roof.

Figure 2:
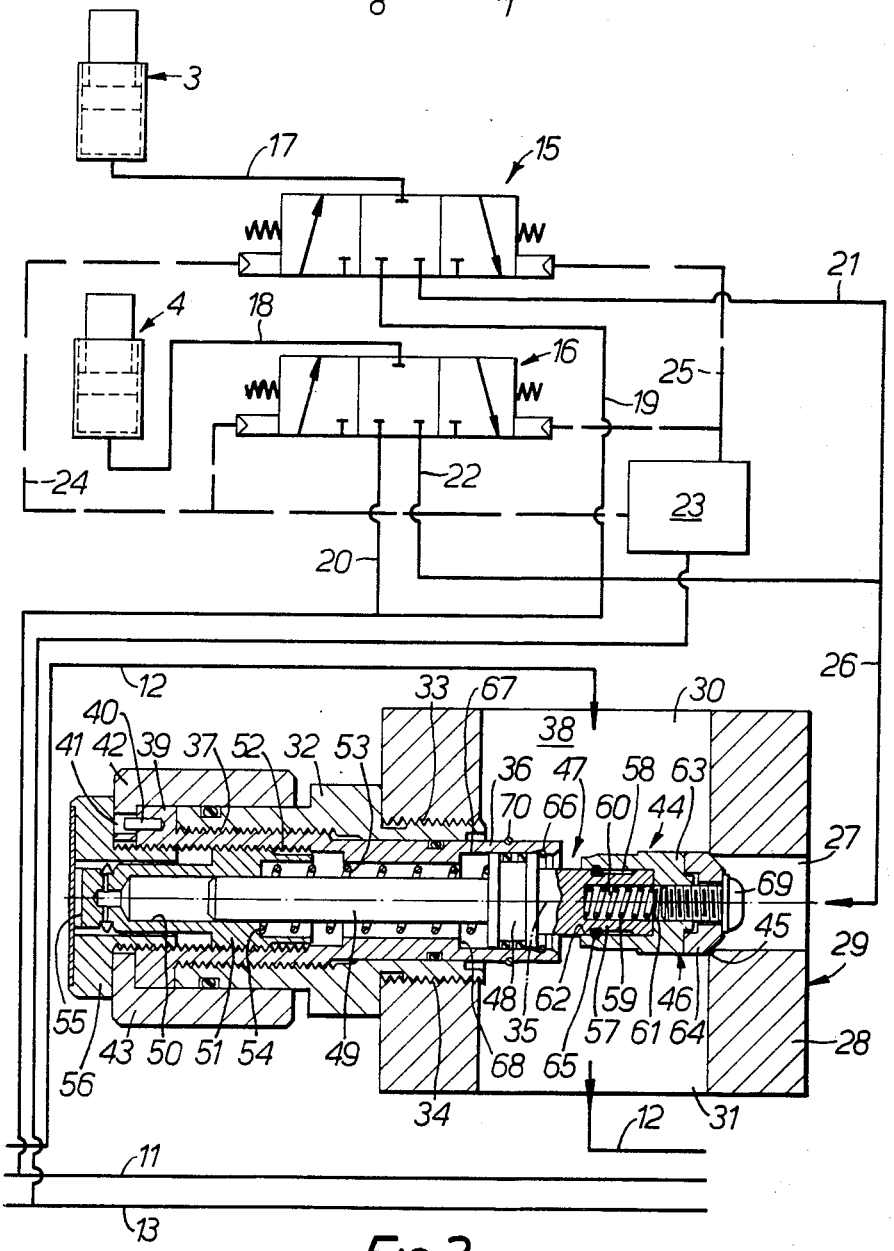
FIG. 2 is an hydraulic circuit diagram associated with the support of FIG. 1.

Referring to FIG. 2, three flexible pipes 11, 12, 13 extend along the whole line of supports. Pipe 11 is a main pipe for supplying liquid at high pressure to the roof supports, being flexible, crush-resistant and of a large bore. Pipe 12 is a main return pipe for carrying liquid discharged from all the roof supports along the mineral face, being flexible, crush-resistant and of a large bore. Pipe 13 is a pilot pressure pipe carrying liquid at moderate pressure for the pilot operation of the valves which control the operation of the roof supports, and is a flexible small-bore pipe, preferably crush-resistant.

For extending and lowering the props 3, 4 control valve means in the form of a pair of double-acting pilot-operated valves 15, 16 are provided and are connected to the working spaces of the props through pipes 17, 18. Both valves 15, 16 are spring-centred so as normally to disconnect pipes 17, 18 respectively from pipes 19, 20 which communicate with main pipe 11 and also respectively from pipes 21, 22.

The operation of the roof support is controlled by a pilot valve assembly 23. Pilot pressure from pipe 13 is directed by this assembly to operate the appropriate control valves 15, 16 for each support function. In addition, other valves (not shown) can be controlled by assembly 23, such as the valve used to control the respective advancing jack 5, return flow from all the advancing jacks being discharged into the line 12. Thus assembly 23 is so operable that its respective roof support can be released from the roof and commence its advancing simultaneously or substantially so.

When assembly 23 is operated to extend the props, liquid in pipe 13 is supplied to pipe 24 to cause displacement of valves 15, 16 to the right in FIG. 2 and pressure liquid in pipe 11 is supplied to pipes 17, 18 to extend the props. Conversely, when it is required to release props 3, 4 for advance of the support, assembly 23 is operated to effect energisation of jack 5 and simultaneously to cause liquid in pipe 13 to be supplied to pipe 25 to cause displacement of valves 15, 16 to the left. Hence, the interiors of props 3, 4 are placed in communication by way of pipes 17, 18 with pipes 21, 22 which both connect with an intermediate pipe 26.

Pipe 26 is connected to the inlet port 27 in the casing 28 of a pressure relief valve 29. This valve is disposed in return pipe 12, ports 30, 31 in casing 28 diagrammatically shown connecting with pipe 12 in the manner indicated.

The relief valve comprises a body member 32 which is screw-threadedly fitted at 33 in an aperture 34 formed in casing 28 opposite port 27. Port 27 and aperture 34 share a common axis 35. A cylinder 36 is screw-threadedly fitted at 37 in body member 32 and projects into the chamber 38 between port 27 and aperture 34 as shown. The cylinder is flanged at 39 at its left-hand end, being there provided with an axially-extending drive pin 40 which engages a drive hole 41 in the flange 42 of a cylindrical manually-operable control member 43. Member 43 is preferably provided with a hand wheel (not shown).

The relief valve includes a movable element 44 which is co-operable with a relief valve seating 45 formed at the left-hand end of port 27. Element 44 comprises two parts, one, 46 of which is connected to the other, 47, with a predetermined amount of lost motion.

At its right-hand end portion in FIG. 2 cylinder 36 houses a piston portion 48 formed integrally with part 47 of element 44. Part 47 also includes a piston rod 49 which extends to the left and which is slidable in bore 50 of an adjuster sleeve 51, which is itself screw-threadedly fitted at 52 towards the left-hand end of cylinder 36. A relief valve spring 53 is interposed between the left-hand end face of piston portion 48 and the face 54 of sleeve 51. Sleeve 51 is provided with a screwdriver slot 55 at its left-hand extremity and a flanged retention element 56 for the member 43 is screw-threadedly engaged with the interior of the cylinder 36.

A stub portion 57 of part 47 extends to the right from portion 48 and is provided with an annular recess 58 of predetermined length in its exterior surface. Portion 57 is provided with a bore 59 open at its right-hand extremity to receive a light coil spring 60 which bears against the inner end 61 of a bore 62 of a thimble-like member 63. Member 63 and a frusto-conical seating part 64 carried thereby together form said one part 46 of element 44.

The bore 62 is provided, in a suitable groove, with a spring ring 65 so positioned as to be co-operable with the annular recess 58 effectively to limit the amount of said lost motion between part 46 and part 47. A further spring ring 66 fits in a suitable groove near the open end of the bore 67 housing the piston portion 48, this ring limiting movement of that portion to the right in FIG. 2, while the shoulder 68 limits movement of the piston to the left.

The frusto-conical seating part 64 is secured to the thimble-like member 63 by a retention screw 69. The fitting of this screw is such as to afford such limited amount of lateral freedom of part 64 with respect to member 63 as to permit the part accurately to engage seating 45 despite any slight out-of-alignment.

During operation of the mine roof support system above described, when it is required to extend the props 3, 4 of a roof support so that roof beam 2 is urged into such engagement with the mine roof as to provide full load support therefor, the appropriate valve in the assembly 23 is operated whereby liquid under pressure from pipe 13 is supplied to pipe 24 to cause valves 15, 16 to move from their neutral positions to the right in the drawing so that liquid under high pressure derived from pipe 11 passes by way of pipes 19, 20, the valves, and pipes 17, 18 to props 3, 4 to extend them. When the desired full load-supporting position of each prop 3, 4 and thus of beam 2 are reached, valves 15, 16 are moved back to their neutral positions so that the props are held hydraulically-locked in their full load-supporting positions.

When, subsequently, it is required to advance the roof support towards the mineral face it is necessary to release roof beam 2 from its full load-supporting engagement with the roof and simultaneously, or substantially so, to cause the advancing jack 5 to be operated. However, on so releasing the support and during advance thereof it is required that props 3, 4 maintain roof beam 2 in light contact with the roof so as to provide some, if only a small, roof-supporting function.

Accordingly, when the appropriate valve in assembly 23 is operated for the purpose of initiating such release of the support and operation of advancing jack 5 to advance the support towards conveyor 7, liquid from pipe 13 is supplied to pipe 25 to cause valves 15, 16 to move away from their neutral positions to the left in FIG. 2, so that props 3, 4 are placed in communication with intermediate pipe 26 by way of pipes 17, 18, the valves and pipes 21, 22.

The high pressure maintained in the props during full roof support is thus released into intermediate pipe 26 and the pressure differential then subsisting across movable element 44 of relief valve 29 causes that element to move away from its seating 45 compressing spring 53.

Liquid passing seating 45 into the interior 38 of the relief valve thereafter enters return pipe 12.

Since, as well as the props 3, 4 shown, other devices along the mineral face are simultaneously discharging liquid at various pressures into pipe 12, the mean pressure in that pipe and thus in the chamber 38 within relief valve 29 can range from a relatively low value to a relatively high value, and thus the pressure differential subsisting across the element 44 is continually changing. Also if in the region where advance of the roof support is taking place, convergence exists between the mine roof and the mine floor, pressure will tend to build up further in props 3, 4 and in intermediate pipe 26 as advance progresses. Conversely, if in that region divergence exists between the roof and the floor, pressure will instead tend to reduce in the props and in the intermediate pipe. Such tendencies to a build-up or to a reduction in pressure also give rise to changes in the pressure differential subsisting across element 44. However by virtue of the construction of the relief valve 29 and the characteristics of its spring 53, provided the pressure subsisting in the return pipe does not exceed the pressure subsisting in the pipe 26 and valves 15, 16, it is intended that a predetermined substantially constant back-pressure is maintained in pipe 26, valves 15, 16 and props 3, 4 during advance of the roof support irrespective of change in pressure in the return pipe and irrespective of any convergence and/or divergence existing between the mine roof and mine floor.

Thus if during advance and due to say roof and floor convergence, with liquid passing through the open relief valve into pipe 12, the pressure in props 3, 4 and thus in pipe 26 increases, the pressure differential across element 44 so increases as further to compress spring 53. Thus the flow area at seating 45 increases, reducing the throttling effect there, whereupon the pressure in the props automatically falls to maintain beam 2 only in light pressure contact with the mine roof so that little resistance to the support-advancing operation is thereby offered. If, conversely, during advance and due to roof and floor divergence, with liquid passing through the open relief valve into pipe 12, the pressure in props 3, 4 and thus in pipe 26 reduces, the pressure diffential across the element 44 so reduces that spring 53 becomes less compressed. Thus the flow area at seating 45 reduces, increasing the throttling effect there, whereupon pressure in the props automatically rises to ensure that beam 2 still contacts the roof but again with only light pressure.

The pressure prevailing in chamber 38 is continually applied to the right-hand end face of piston portion 48 and to the effective left-hand end face area of the thimble-like member 63. Thus, and since lost motion is provided between parts 46 and 47 of element 44, if the pressure in the pipe 12 becomes so high as to approach the value of the predetermined substantially constant back-pressure maintained in the props 3, 4, valves 15, 16 and pipe 26, then part 47 of element 44 is moved to the left with respect to part 46, compressing spring 53. This movement is limited by engagement of portion 48 with the shoulder 68 after which no further compression of spring 53 can take place. Part 46 itself, now subjected on its left-hand side to the higher pressure prevailing in pipe 12, and no longer under the influence of spring 53, continues to co-operate with seating 45 to maintain the predetermined substantially constant back-pressure in the props. Piston portion 48 provides an auxiliary piston area which is equal to the effective area of part 46 exposed to port 27 but the pressure in pipe 12, which is applied to portion 48, produces a force on part 47 which, due to the lost motion provided between parts 46 and 47, is not additive to the force which is applied to the part 46 as a result of the back-pressure subsisting in pipe 26.

By virtue of the presence of the light coil spring 60, when the main return line pressure reaches the said predetermined value the relief pressure effective on props 3, 4 equals the main return line pressure plus a small addition (for example 5 psi). Thus upon the main return line pressure exceeding the said predetermined value, part 46 of element 44 moves with respect to part 47 towards seating 45 aided by spring 60, and upon closing of part 46 onto that seating, pipe 12 is isolated from pipe 26, valves 15, 16 and props 3, 4. Hence liquid under pressure now in excess of the said predetermined value and present in pipe 12 is prevented from reaching the props and otherwise so extending them as to load beam 2 against the mine roof with such force as undesirably to resist satisfactory advance of the roof support.

When desired the manually-operable control member 43 can be turned with respect to the body member and by virtue of drive hole 41 and pin 40 such turning effects rotation of cylinder 36. Since cylinder 36 is screw-threadedly engaged in body member 32 such turning in the appropriate direction causes axial movement of the cylinder until spring ring 70, which acts as a stop and which is seated in a suitable groove in the exterior surface of the cylinder, engages the right-hand extremity of member 32. In this way the cylinder, complete with spring 53 and movable valve element 44, is retracted in a direction away from seating 45 so that the predetermined substantially constant back-pressure otherwise developed in pipe 26 and props 3, 4 upon support advance is released. By this means the facility for light contact of roof beam 2 with the roof during advance can be removed at will should mining conditions make normal lowering of the props more appropriate, and upon such release liquid in the props is permitted to pass directly to pipe 12 provided the pressure in that pipe is below said value.

The predetermined pressure at which valve 29 relieves when the system is operating with cylinder 36 in the position shown in FIG. 2 may be suitably adjusted by screwing adjuster sleeve 51 in the appropriate direction by application of a screwdriver to slot 55. Such adjustment effects change in the preloading of coil spring 53 and takes place independently of control member 43.

I claim:

1. A mine roof support system including a plurality of hydraulically-operated mine roof supports each having a roof beam and at least one extendible prop for raising the roof beam into engagement with the mine roof, means associated with each said support for advancing it towards the working face of the mine, control valve means for each support, a main supply pipe for supplying liquid at high pressure and by way of respective said control valve means to said prop or props of each of said supports for full roof support, a main return pipe, a respective relief valve connected to discharge liquid into said main return pipe and including a movable element and a seating with which said element is co-operable, said relief valve being communicable with said prop or props by way of its associated said control valve means when said liquid at high pressure is no longer supplied to said prop or props and the respective said roof support is being advanced by said advancing means, said movable element of each said relief valve comprising at least two relatively-movable parts, which are connected together with a predetermined amount of lost motion, and being so co-operable with said seating as to ensure that when said support is so advancing a substantially constant predetermined back-pressure is maintained in said prop or props sufficient to maintain the roof beam of the respective said support in only light pressure contact with the mine roof, but if the pressure in said main return pipe exceeds the pressure then subsisting in said control valve means, one of said parts of said element is caused automatically to close onto said seating.

2. A system as claimed in claim 1, wherein said one part of said movable element is of thimble-like form and said other part includes a hollow stub portion upon which said one part of the element is slidably mounted, a spring being disposed within said stub portion for biassing said one part towards said seating.

3. A system as claimed in claim 2, wherein an annular recess is provided in the exterior surface of said stub portion and a spring ring, which is disposed in a groove in the interior surface of said one part, is co-operable with said recess to afford said connection of said parts of said movable element with said predetermined amount of lost motion.

4. A system as claimed in claim 3, wherein said other part of said movable element is in engagement with one end of a relief valve spring, the other end of that spring being engaged by adjuster means.

5. A system as claimed in claim 4, wherein said other part of said movable element, said relief valve spring and said adjuster means are together housed in a cylinder which is itself screw-threadedly engaged with respect to the casing of the relief valve, and wherein a control member is adapted to so turn said cylinder as to move said adjuster means, said relief valve spring and said other part of said movable element together axially as one with said one part of said element.

* * * * *